US005793021A

United States Patent [19]

Walton

[11] Patent Number: 5,793,021

[45] Date of Patent: Aug. 11, 1998

[54] COOKTOP RANGE PROTECTIVE COVER

[76] Inventor: Stephanie S. Walton, 13447 Nascoby La., Dale City, Va. 22193

[21] Appl. No.: 510,231

[22] Filed: Aug. 2, 1995

[51] Int. Cl.[6] ..... F24C 15/10

[52] U.S. Cl. ..... 219/444; 126/211

[58] Field of Search ..... 126/211, 217–218, 126/220, 221, 42, 22; 219/444

[56] References Cited

U.S. PATENT DOCUMENTS

| | | | |
|---|---|---|---|
| 279,421 | 6/1883 | Noyes . | |
| 1,000,185 | 8/1911 | Melton . | |
| 1,461,856 | 7/1923 | Robertson . | |
| 2,175,420 | 10/1939 | Williams et al. | 126/42 |
| 2,292,735 | 8/1942 | Besocke | 126/42 |
| 2,390,234 | 12/1945 | Applebaum | 126/42 |
| 2,445,124 | 7/1948 | Reeves | 126/37 |
| 2,514,133 | 7/1950 | La Barre et al. | 126/43 |
| 2,568,276 | 9/1951 | Eggleston | 126/1 |
| 3,463,076 | 8/1969 | Keating | 99/349 |
| 4,155,343 | 5/1979 | Hartman | 126/42 |
| 4,527,540 | 7/1985 | Ryan et al. | 126/42 |
| 4,836,181 | 6/1989 | Saga | 126/42 |
| 5,158,068 | 10/1992 | Pickering | 126/215 |
| 5,357,942 | 10/1994 | Williams et al. . | |

*Primary Examiner*—Teresa J. Walberg
*Assistant Examiner*—Jam Paik
*Attorney, Agent, or Firm*—Joseph W. Berenato, III

[57] ABSTRACT

In combination, a range having at least a first burner and a first burner control disposed on a horizontal surface. First and second spaced vertically disposed guide tracks are secured to the range proximate the first burner. A cover is operably connected to the range. The cover has a vertical orientation permitting access to the burner and the burner control, and a horizontal orientation covering the burner and the burner control for prohibiting access thereto. A handle extends from the cover for permitting the cover to be shifted between the orientations. First and second rollers are secured to an extend from the cover, and are each received in one of the guide tracks for guiding movement of the cover during shifting thereof between the orientations.

19 Claims, 5 Drawing Sheets

Fig. 5
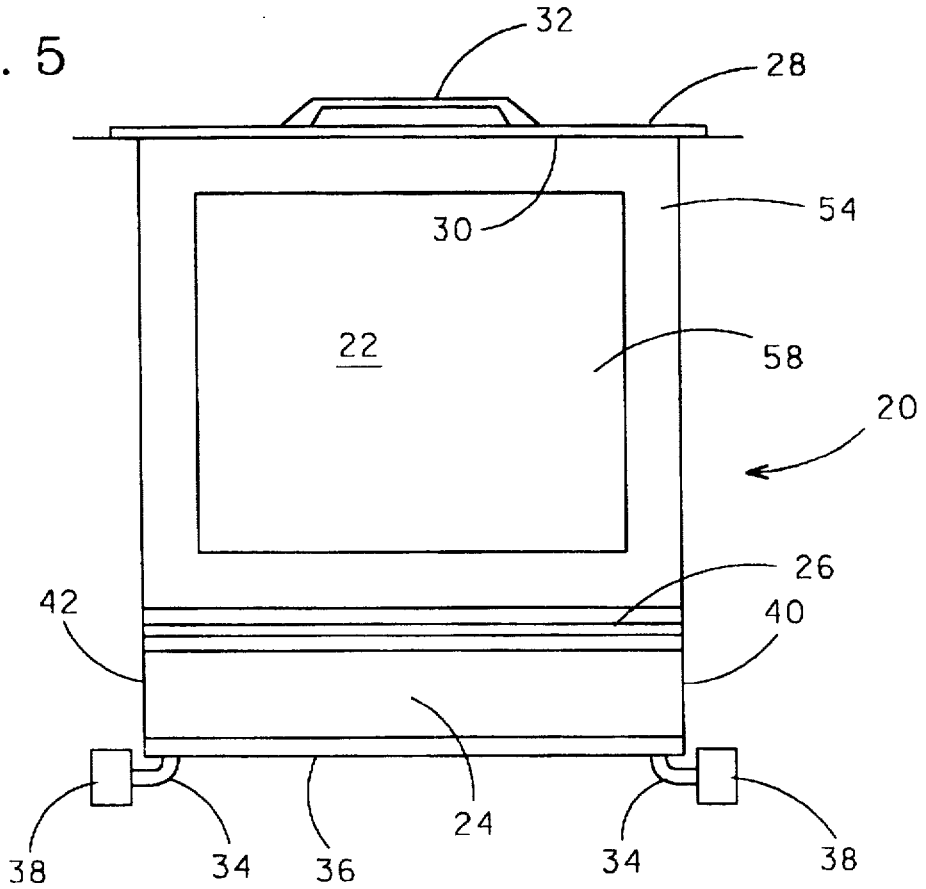
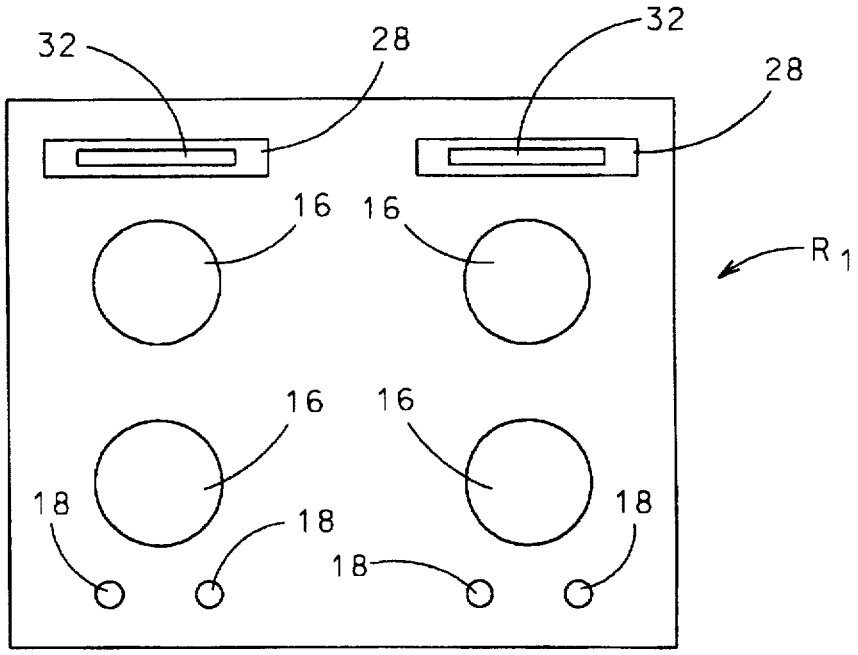
Fig. 6

Fig. 7
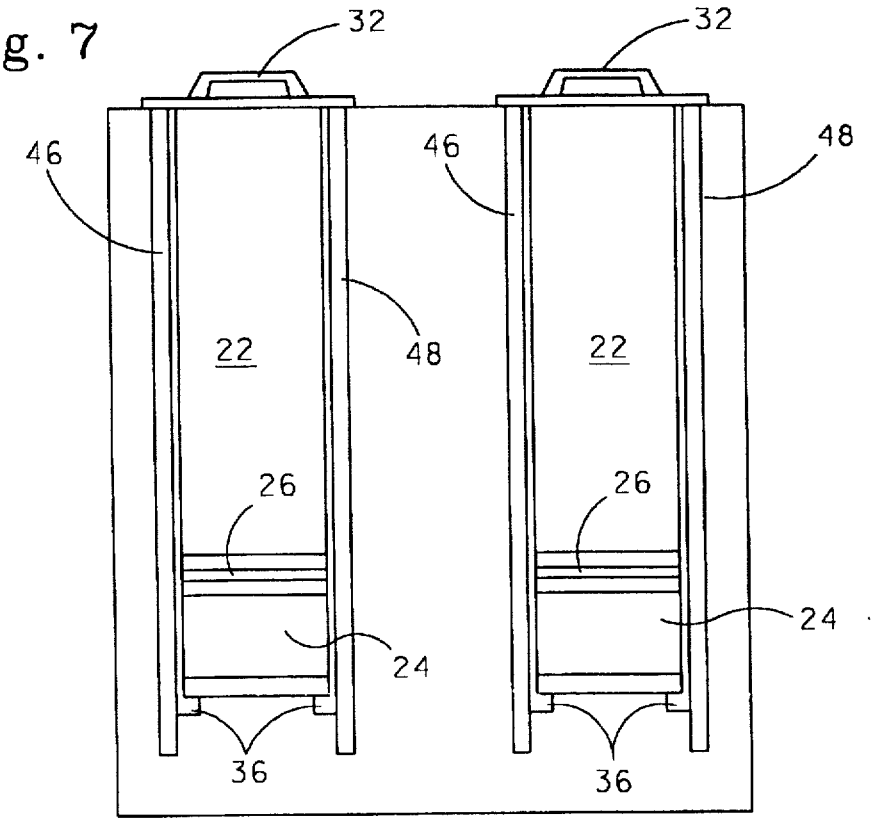
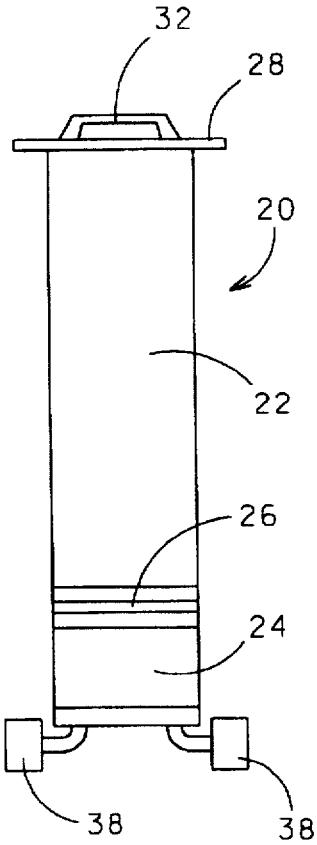
Fig. 8

COOKTOP RANGE PROTECTIVE COVER

FIELD OF THE INVENTION

The disclosed invention is a protective cover used with a cooktop range to preclude the burner controls and thereby the burners from being accidentally operated, such as by children. More specifically, the disclosed invention is a cover which in a first vertical orientation is recessed within the cabinet of the cooktop range to permit access to the burners and the burner controls, and in a second horizontal orientation covers the burners and the burner controls to enhance safety.

BACKGROUND OF THE INVENTION

A standard cooktop range or a standard range integral with an oven has a horizontal upper surface on which one or more burners, whether electric or gas, are provided for cooking purposes. There usually is a knob which is rotated by the user to actuate the particular burner of interest. The control knobs may be along the front of the range or, particularly with the cooktop ranges, may be on the horizontal surface between burners. Regardless of where located, however, the burner controls and the burners are at an elevation where they may be accessed by children who thereafter may become burned. Alternatively, the burner controls may be unintendedly actuated, with the result that someone may become burned or some other accident arise through contact with the heated burner.

The cooktop ranges frequently are provided on an "island" which is remote from the oven. Generally there is a cabinet on which the cooktop range sits, with the electric and/or gas supplies being housed within the cabinet. The cabinet frequently is empty, or it may have drawers, doors, and the like for storage purposes. In any event, however, the cabinet frequently has a relatively unobstructed open area to permit access to the supply lines.

Because of the potential hazards arising from unintended operation of the burners, then there is a need for a safety device which will preclude operation of the burners and prevent heated burners from being contacted. Regardless of how protected, the safety device must assure that the burners may be used when desired, that the safety device is available when needed, and that the safety device is unobtrusive both when permitting access to the burners and when in its safety position. The disclosed invention meets these needs by providing a cover which in a substantially vertical orientation is housed within the cabinet of the cooktop range to permit access to the burners and their controls, and in a horizontal orientation covers the burners and controls to prevent the controls from being operated and/or heated burners from being unintendedly contacted.

SUMMARY OF THE INVENTION

In combination, there is a range having at least a first burner and a first burner control disposed on a horizontal surface thereof. First and second vertically disposed guide tracks are secured to the range proximate the first burner. A cover is operably connected to the range. The cover has a vertical orientation permitting access to the burner and the burner control, and a horizontal orientation covering the burner and the burner control for prohibiting access thereto. A handle extends from the cover for permitting the cover to be shifted between the orientations. First and second rollers are secured to and extend from the cover and are each received in one of the guide tracks for guiding movement of the cover as it is being shifted between the orientations.

A protective cover for a range comprises first and second juxtaposed cooperating panels. A hinge interconnects the panels and permits the first panel to pivot relative to the second panel. A handle is secured to the second panel for permitting the second panel and thereby the first panel to be moved linearly and for permitting pivoting of the second panel. At least first and second rollers are secured to and extend from the first panel for facilitating movement of the panels and for engagement with a stop delimiting linear movement of the first panel.

These and other object and advantages of the invention will be readily apparent in view of the following description and drawings of the above-described invention.

DESCRIPTION OF THE DRAWINGS

The above and other objects and advantages and novel features of the present invention will become apparent from the following detailed description of the preferred embodiment of the invention illustrated in the accompanying drawings, wherein:

FIG. 5 is a front elevational view of the cover of the invention;

FIG. 6 is a top plan of a second embodiment of the invention;

FIG. 7 is a rear elevational view of the embodiment of FIG. 6;

FIG. 8 is an elevational view of one of the covers of FIG. 6;

DETAILED DESCRIPTION OF THE INVENTION

Figure 1:
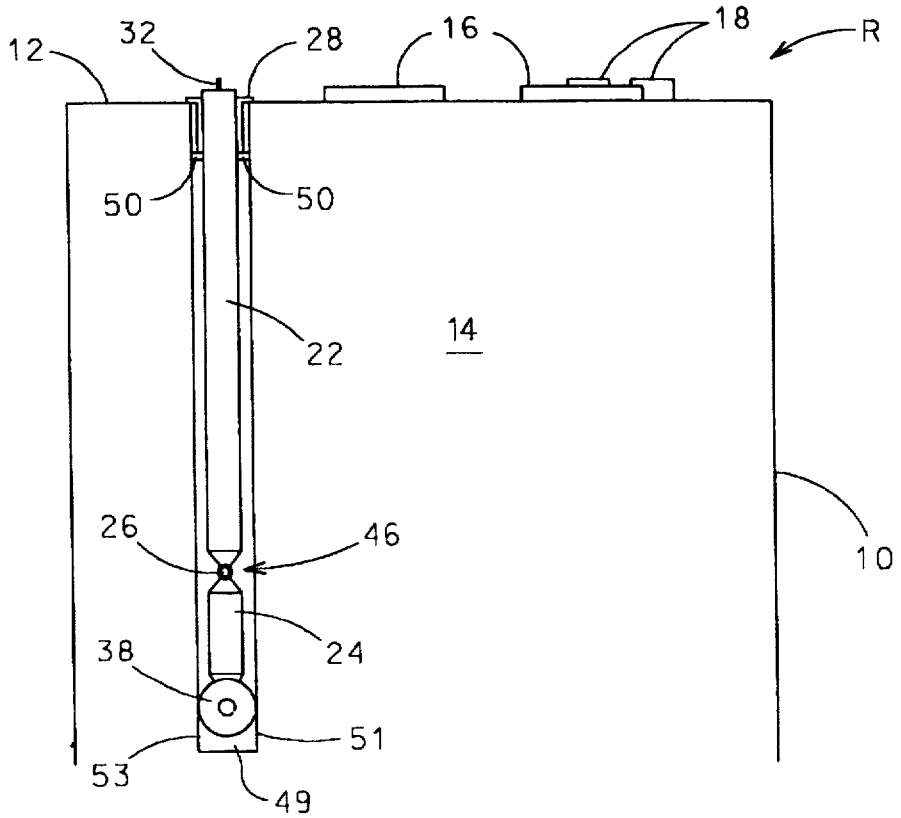
FIG. 1 is a fragmentary cross-sectional view of the cover of the invention in vertical orientation relative to the cooktop range.
Figure 2:
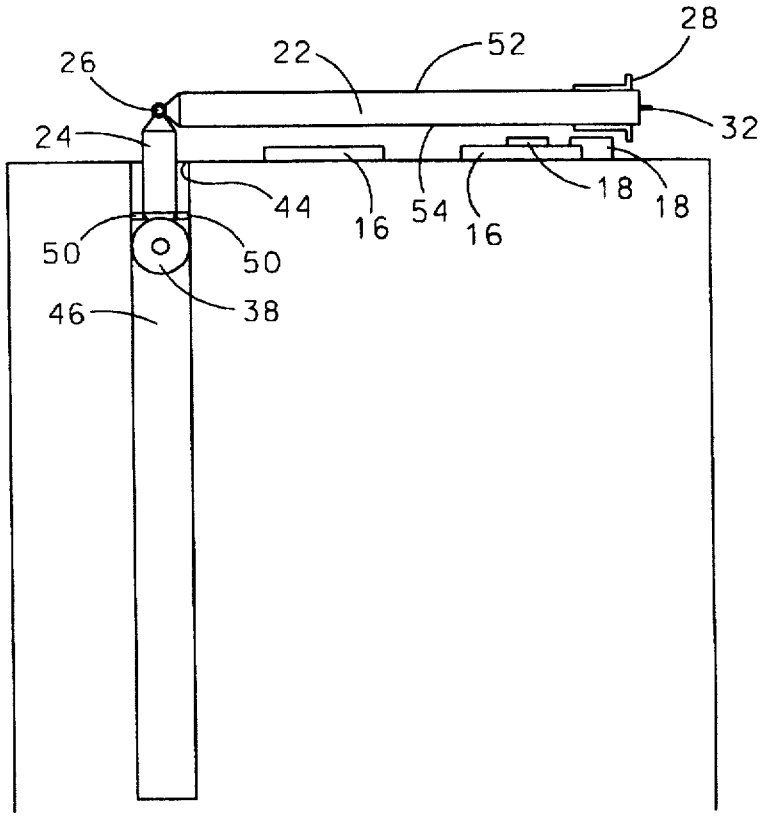
FIG. 2 is a view similar to that of FIG. 1 with the cover in the horizontal orientation.
Figure 3:
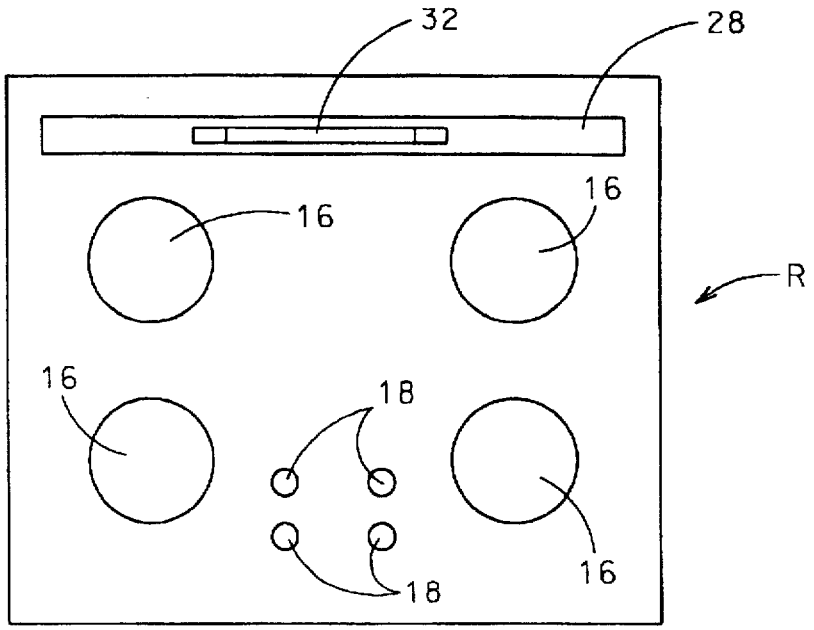
FIG. 3 is a top plan view of the cover and cooktop range of FIG. 1.
Figure 4:
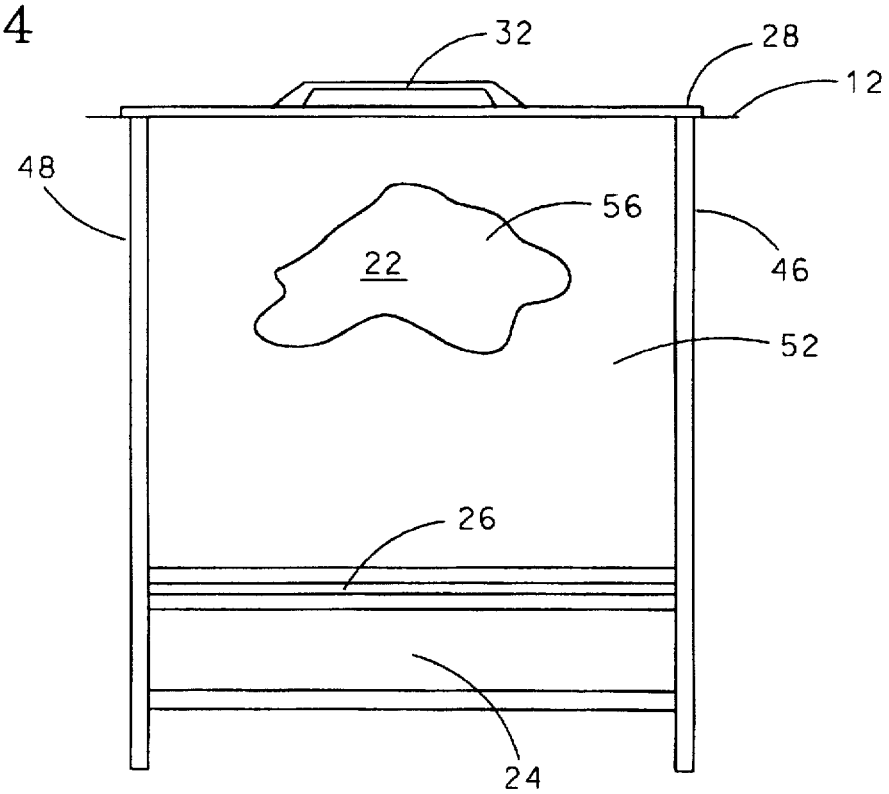
FIG. 4 is a rear elevational view of the cover of the invention positioned within the guide tracks.

Cooktop range R, as best shown in FIGS. 1–3, includes a cabinet 10 with an upper horizontal surface 12. The cabinet 10 may be formed from wood, metal, or other satisfactory material. The cabinet 10 and the horizontal surface 12 may be integral with an oven range, disposed on a countertop, or may be part of a separate remote "island". Regardless of the configuration of cabinet 10, it will have a substantially unobstructed open internal area 14 to permit access to burners, supply lines, and the like.

Burners 16 are positioned on horizontal surface 12, as best shown in FIGS. 1 and 3. There may be four burners 16, with the burners being the same size or different sizes, and with the burners being heated electrically or with gas. Those skilled in the art will understand that the burners 16 are provided to heat cooking implements, such as pots, pans, and the like, and the disclosed invention is useful with essentially any type of burner 16. Each of the burners 16 has a burner control 18, usually in the form of a rotatable knobs permitting the temperature of the particular burner 16 to be appropriately adjusted. It can be noted in FIG. 1 that the burner controls 18 extend above the burners 16, although same is not a necessary requirement for the invention.

Cover 20, as best shown in FIG. 5, has a first upper rectangular panel 22 and a second lower rectangular panel 24. Cover 20 may be metal or other material resisting the heat of the burners 16. Hinge 26, such as a piano hinge or the like, hingedly interconnects the panels 22 and 24 to permit the panel 22 to pivot relative to the vertical orientation of panel 24. Plate 28 extends along the upper edge 30 of first panel 22, and is sized so that the plate 28 extends beyond the panel 22 both laterally and longitudinally. Handle 32 is secured to plate 28 and extends therefrom in the plane of panel 22. Handle 32 may be grasped by the user, as further explained, to shift the cover 20 from the cover or horizontal orientation of FIG. 2 to the vertical orientation of FIG. 1.

Shafts 34 are secured to the lower edge 36 of second panel 24 and extend longitudinally therebeyond in the plane of the panel, as best shown in FIG. 5. Rollers 38 or wheels are secured to each of the shafts 34 and are spaced from the side edges 40 and 42 of second panel 24.

Range R has a slot or opening 44 formed in upper surface 12 rearwardly of the burners 16. Slot 44 preferably is rectangular in shape. C-shaped guide tracks 46 and 48 are positioned within open area 14 and extend downwardly from horizontal surface 12. Each of the tracks 46 and 48 is secured to the horizontal surface 12 at a lateral edge of slot 44. The tracks 46 and 48 may be fabricated from bent sheet metal, plastic, or like material. Track 46, as an example, has a wall member 49, from which arms 51 and 53 extend to substantially surround roller 38. Track 48 is similarly constructed in order to capture the roller.

A stop or stops 50, in the form of a protrusion, spike, or bent piece of die cut sheet metal, extends into the open area of the C-shape tracks 46 and 48 to engage the rollers 38 carried by the second panel 24. I prefer that there be at least one stop for each of tracks 46 and 48, although there may be two stops 50, as best shown in FIGS. 1 and 2. The stops 50 delimit vertical linear movement of the cover 20 as it is pulled by the handle 32 from the vertical orientation of FIG. 1 to the horizontal or cover orientation of FIG. 2.

Use of the cover 20 with the range R is relatively simple and yet provides enhanced safety with the cooktop range R. In the vertical orientation of FIG. 1, then the plate 28, because it is larger in the longitudinal and lateral dimensions than the slot 44, will engage the upper horizontal surface 12 and maintain the cover 20 in position. The burners 16 and burner controls 18 therefore may be accessed by a user. Should the user wish to cover the burners 16 and controls 18, then same may be quickly done with the cover 20. In that event, the user need grasp the handle 32 and pull the cover 20 vertically upwardly so that the rollers 38 move within the guide tracks 46 and 48. When the rollers 38 engage the stops 50, however, then vertical movement is no longer possible, and the user may then pivot the panel 22 into the horizontal orientation of FIG. 2. Because of the dimensioning of the plate 28, then one edge of the plate 28 rests on the horizontal surface 12 and thereby spaces the panel 22 above the burners 16 and burner controls 18 while at the same precluding access thereto. It can be noted in FIG. 2 that, in the horizontal orientation, the hinge 26 is above the horizontal surface 12 and thereby permits the panel 22 to assume the horizontal orientation.

Should the user wish to shift the cover 20 from the horizontal orientation of FIG. 2 to the vertical or access-permitting orientation of FIG. 1, then it is simply necessary to again grasp the handle 32 and pivot the cover 22 toward the vertical orientation, while at the same time permitting the second panel 24 and the rollers 38 to be lowered into the open area 14 while being guided by the tracks 46 and 48. Once the cover 20 has been lowered, then, as earlier noted, the plate 28 engages the surface 12 and thereby maintains the cover 20 in the vertical orientation, so that the user may access the burners 16 and the burner controls 18 for cooking purposes.

Those skilled in the art will understand that the panel 22 has surfaces 52 and 54 on opposite sides thereof, as best shown in FIG. 2. The surface 52 may have decorative material 56 applied thereto over the entirety or a portion thereof to enhance the aesthetic appeal of the cover 20. For example, the decoration may be some scene, color component, or the like which enhances the attractive nature of the cover 20 when in the horizontal orientation of FIG. 2. The surface 54, on the other hand, may have a heat insulating material 58, such as fiberglass or the like, applied thereto to provide enhanced thermal resistance when the cover 20 is in the horizontal orientation. Thus, there is an air gap between cover 20 and burners 16 and thermal insulation 58, which may be important when the cover 20 is initially moved to the horizontal orientation while the burners 16 are still hot.

The embodiment of FIGS. 6–8 is similar to that of FIGS. 1–5 and provides two covers 20 instead of a single unitary cover. For this reason, like numbers denote like parts. Unlike the embodiment of FIGS. 1–5, the burner controls 18 are forwardly disposed relative to the burners 16 on range R1. I thus provide two covers 20, with each cover 20 available to cover two aligned burners 16 and their cooperating controls 18. Naturally, there are appropriate tracks 46 and 48 in which the rollers 38 are guided, and also stops to delimit vertical movement of the covers 20. One of the covers 20 may be in the horizontal orientation, while the other one of the covers 20 may be in the vertical orientation and thereby permit access to the burners 16 and burner controls 18.

Figure 9:
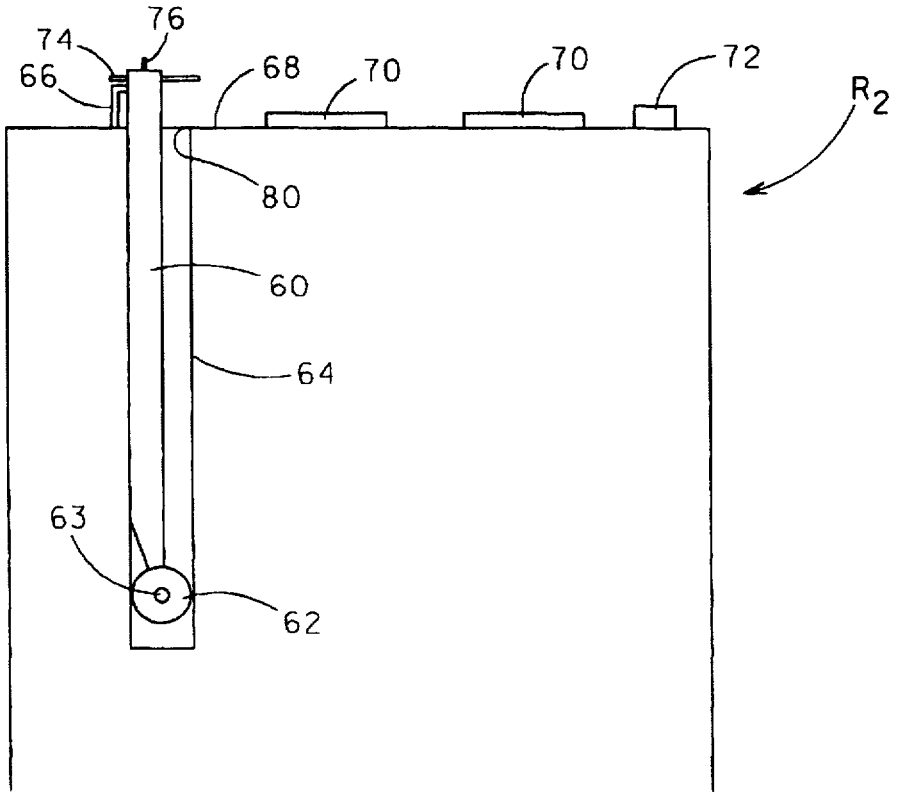
FIG. 9 is a side elevational view partially in section of a third embodiment of the invention with the cover in the vertical orientation.
Figure 10:
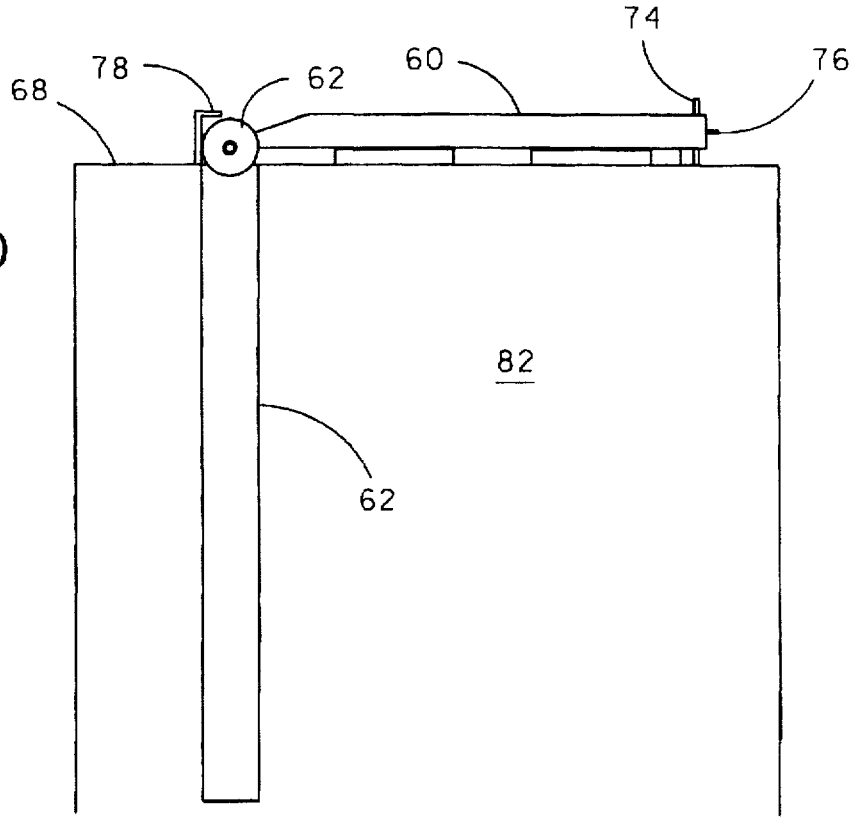
FIG. 10 is a view similar to that of FIG. 9 with the cover in the horizontal orientation.

The range R2 of FIGS. 9–10 and the cover 60 are similar to the ranges R and R1 of FIGS. 1–8 and the covers 20, although certain modifications are herein explained. Unlike the covers 20, the cover 60 is a single panel having rollers 62, only one of which is shown in FIGS. 9 and 10 projecting longitudinally away in order to be received in associated guide tracks 64. Although only one guide track 64 is illustrated in FIGS. 9–10, those skilled in the art will understand that there is a guide track 64 at each side edge of the cover 60 for the reasons pertaining to the guide tracks 46 and 48 of FIGS. 1–8. Each of the guide tracks 64 is C-shaped, although other configurations are available.

Because the cover 60 is not a bi-fold arrangement as with the covers 20, then I provide an extension element 66 extending from the guide tracks 64 upwardly above the horizontal surface 68 of the range R2. As with the range R, burners 70 and burner controls 72 are disposed on the horizontal surface 68 for the previous reasons. Because the cover 60 is not a bi-fold arrangement, then the extension element 66 permits the pivot point defined by the shaft 63 of the rollers 62 to be sufficiently high so that the cover 60 may pivot and cover the burners 70 and controls 72 without the plate 74 being too large. As with the previous covers, a handle 76 extends from the plate 74 to permit shifting of the cover between the vertical orientation of FIG. 9 and the horizontal orientation of FIG. 10.

As with the tracks 46 and 48, I provide a stop 78 on the guide tracks 64. Because of the panel 24 of the covers 20, then the stops 50 of the guide tracks 46 and 48 are positioned below the horizontal surface 12, while the stops 78 of the guide track 64 for the cover 60 needs to be positioned above the horizontal surface 68 to permit pivoting of the cover 60.

The cover 60 therefore provides a relatively small open portion forwardly of the cover 60 adjacent one edge of the slot 80. This may permit entry of dirt, ingredients and the like, so it may be advisable to provide a resilient seal around the slot 80 to brush against the cover 60. A seal thus would minimize entry of particulates into the open area 82 of the range R2.

While this invention has been described as having a preferred design, it is understood that it is capable of further modifications, uses, and/or adaptations, following in general the principal of the invention, and including such departures from the present disclosure as come within known or customary practice in the art to which the invention pertains, and as may be applied to the central features hereinbefore set forth, and fall within the scope of the invention of the limits of the appended claims.

What I claim is:

1. In combination, a) a range having at least a first burner and a first burner control disposed on a horizontal surface;

b) first and second vertically disposed guide tracks secured to said range proximate said first burner; and c) a cover operably connected to said range, said cover having a vertical orientation permitting access to said burner and said burner control and a horizontal orientation covering said burner and said burner control for prohibiting access thereto, a handle extends from said cover for permitting said cover to be shifted between said orientations, and first and second rollers are secured to and extend from said cover and are each received in one of said guide tracks for guiding movement of said cover during shifting between said orientations.

2. The combination of claim 1, wherein:

a) a stop member is operably associated with at least one of said guide tracks and engageable with the roller associated therewith for delimiting vertical movement of said cover.

3. The combination of claim 2, wherein:

a) said stop member is disposed intermediate remote ends of said guide tracks.

4. The combination of claim 3, wherein:

a) each of said guide tracks is C-shaped; and b) said stop member is disposed within said guide tracks.

5. The combination of claim 4, wherein:

a) there are two stop members, and each of said stop members is disposed within an associated guide track.

6. The combination of claim 5, wherein:

a) said cover has first and second panels, and a hinge interconnects said panels;

b) said handle extends from said first panel above said horizontal surface when said cover is in said vertical orientation; and c) said rollers extend from said second panel.

7. The combination of claim 6, further including:

a) a slot in said horizontal surface; and b) each of said guide tracks is secured to said slot and extends downwardly therefrom.

8. The combination of claim 7, wherein:

a) said cover has an end portion larger than said slot for engagement with said horizontal surface for thereby maintaining positioning of said cover when in said vertical orientation.

9. The combination of claim 8, wherein:

a) said second panel has upper and lower end portions, said hinge connected to said upper end portion and said rollers secured to said lower end portion.

10. The combination of claim 1, wherein:

a) said cover has first and second surfaces;

b) a heating insulating material is secured to said first surface for being adjacent said burner when said cover is in said horizontal orientation; and c) a decorative element is applied to said second surface for being perceivable to a user when said cover is in said horizontal orientation.

11. The combination of claim 10, wherein:

a) said cover is formed from metal.

12. The combination of claim 1, further comprising:

a) at least four burners and four burner controls on said horizontal surface; and b) said cover sized for covering said four burners and said four burner controls when in said horizontal orientation.

13. The combination of claim 1, further comprising:

a) at least four burners and four burner controls on said horizontal surface; and b) at least two covers operably associated with said range, each of said covers sized for covering two burners and two burner controls when in said horizontal orientation.

14. The combination of claim 1, wherein:

a) said guide tracks each have a portion extending upwardly beyond said horizontal surface; and b) a stop member is operably associated with at least one of said guide tracks and is disposed above said horizontal surface for engagement with an associated one of said rollers for delimiting vertical movement of said cover.

15. The combination of claim 14, wherein:

a) said handle extends above said horizontal surface when said cover is in said vertical orientation; and b) said rollers are secured to a lower end portion of said cover.

16. The combination of claim 15, wherein:

a) said rollers extend laterally beyond associated side edge portions of said cover.

17. The combination of claim 15, wherein:

a) said cover has an end portion extending therefrom and engageable with said guide track portions when said cover is in said vertical orientation for maintaining positioning of said cover.

18. The combination of claim 17, wherein:

a) said end portion has an edge engageable with said horizontal surface for maintaining positioning of said cover when in said horizontal orientation.

19. A protective cover for a range, comprising:

a) first and second juxtaposed cooperating panels;

b) a hinge interconnects said panels and permits said first panel to pivot relative to said second panel;

c) a handle secured to said second panel for permitting said second panel and thereby said first panel to be moved linearly and for permitting pivoting of said second panel; and d) at least first and second rollers secured to and extending from said first panel for facilitating movement of said panels and for engagement with a stop delimiting the linear movement of said first panel.

* * * * *